US005385194A

United States Patent [19]

Brown

[11] Patent Number: 5,385,194

[45] Date of Patent: Jan. 31, 1995

[54] FABRIC PANEL CLEAN CHANGE-OUT FRAME

[76] Inventor: Ronald M. Brown, 1757 Dorset Ave., Pocatello, Id. 83201

[21] Appl. No.: 33,473

[22] Filed: Mar. 18, 1993

[51] Int. Cl.[6] ..... A47H 23/00

[52] U.S. Cl. ..... 160/354; 160/327; 160/368.1; 405/128; 588/249; 588/900; 52/222; 52/489.1

[58] Field of Search ..... 160/327, 354, 369, 371; 52/222, 489; 588/249, 900; 405/128

[56] References Cited

U.S. PATENT DOCUMENTS

| | | | |
|---|---|---|---|
| 2,489,477 | 11/1949 | Brecher | 52/489 X |
| 2,744,346 | 5/1956 | Auerbach-Levy | 160/369 X |
| 3,149,665 | 9/1964 | Hanford | 160/327 |
| 3,186,712 | 6/1965 | Kessler | 52/222 X |
| 3,205,628 | 9/1965 | Frisk | 160/354 X |
| 3,405,489 | 10/1968 | Frisk | 52/222 |
| 3,553,942 | 1/1971 | Harrington et al. | 160/371 X |
| 5,058,340 | 10/1991 | Muller | 52/222 |

FOREIGN PATENT DOCUMENTS

| | | | |
|---|---|---|---|
| 1518396 | 2/1968 | France | 160/327 |

*Primary Examiner*—Blair M. Johnson

[57] ABSTRACT

A fabric panel clean change-out frame, for use on a containment structure having rigid walls, is formed of a compression frame and a closure panel. The frame is formed of elongated spacers, each carrying a plurality of closely spaced flat springs, and each having a hooked lip extending on the side of the spring facing the spacer. The closure panel is includes a perimeter frame formed of flexible, wedge-shaped frame members that are receivable under the springs to deflect the hooked lips. A groove on the flexible frame members engages the hooked lips and locks the frame members in place under the springs. A flexible fabric panel is connected to the flexible frame members and closes its center.

16 Claims, 2 Drawing Sheets

FABRIC PANEL CLEAN CHANGE-OUT FRAME

CONTRACTUAL ORIGIN OF THE INVENTION

The United States Government has rights in this invention under Contract No. DE-AC11-88PN38014.

TECHNICAL FIELD

The invention generally relates to movable or removable closures. More specifically, the invention relates to superimposed closures and removable closures, especially those with a displaceable sealing strip. According to another aspect, the invention generally relates to flexible and portable closures. More specifically, the invention relates to framed fabric closures suited for use with containments, such as glove boxes.

BACKGROUND ART

Rigid-structured containments are employed in the processing of nuclear, biological, chemical or other material whose spread into the general environment is regarded as undesirable contamination. According to the state-of-the art, a typical containment is a glove box, which is provided with glove ports to which flexible gloves are mounted. The glove box permits a worker outside the containment to manipulate materials within the containment. Also, a glove box permits change-out of a glove without requiring opening the containment, as it can be important that the integrity of the containment be maintained. However, no method is known to permit such clean change-out with irregularly shaped fabric panels. The use of glove boxes and similar containments is increasing in both the nuclear and nonnuclear industries, as the trend is to contain the work rather than the worker.

Fabric panels are employed on containments and glove boxes for several purposes. They provide a flexible seal between two parts of the containment that move relative to each other, or that are misaligned, or that vibrate enough to ruin a rigid connection. Further, they are used on some portable containments in lieu of steel or Lexan walls to reduce weight. Additionally, they are used to cover large passage openings used to pass in and out large items. In view of these many uses, the ability to replace the fabric panel without opening the containment would be very valuable, especially on containments with more hazardous interior elements. It has been necessary to construct and remove secondary contamination barriers at the time of a change-out, which is a source of delay and expense.

Therefore, it would be desirable to have a means of securing a fabric panel to a glove box or containment in a contamination-controlling manner, wherein the panel can be changed without violating the integrity of the containment.

In particular, it would be desirable to have a means of securing a fabric panel to a containment in such as way that the fabric panel can be replaced with a new one without first removing the old one.

To achieve the foregoing and other objects and in accordance with the purpose of the present invention, as embodied and broadly described herein, the fabric panel clean change-out frame and method of use of this invention may comprise the following.

DISCLOSURE OF INVENTION

Against the described background, it is therefore a general object of the invention to provide an improved device that can be built into a glove box or containment with a rigid structure to hold a panel of fabric in place in a contamination-controlling manner.

A more specific object is to provide a method and device that will allow a fabric panel to be replaced with a new one without first removing the old one.

Another object is to provide a method and a device that will allow the clean passage of items into glove boxes or containments.

A further object is to provide a device and method that will enable the use and clean replacement of fabric panels of unique and irregular shapes on containments.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, the fabric panel clean change-out frame is used in combination with a rigid walled structure that has an opening defined through its wall. The change-out frame is constructed of a closure panel of predetermined shape, including a central portion formed of flexible sheet material and a flexible perimeter frame joined to this central portion. The perimeter frame tapers in thickness toward its outside edge. Further, in use a compressing mechanism is mountable on the rigid walled structure in the approximate shape of the closure panel for retaining the perimeter frame under pressure.

The accompanying drawings, which are incorporated in and form a part of the specification, illustrate preferred embodiments of the present invention, and together with the description, serve to explain the principles of the invention. In the drawings:

BEST MODE FOR CARRYING OUT THE INVENTION

Figure 1:
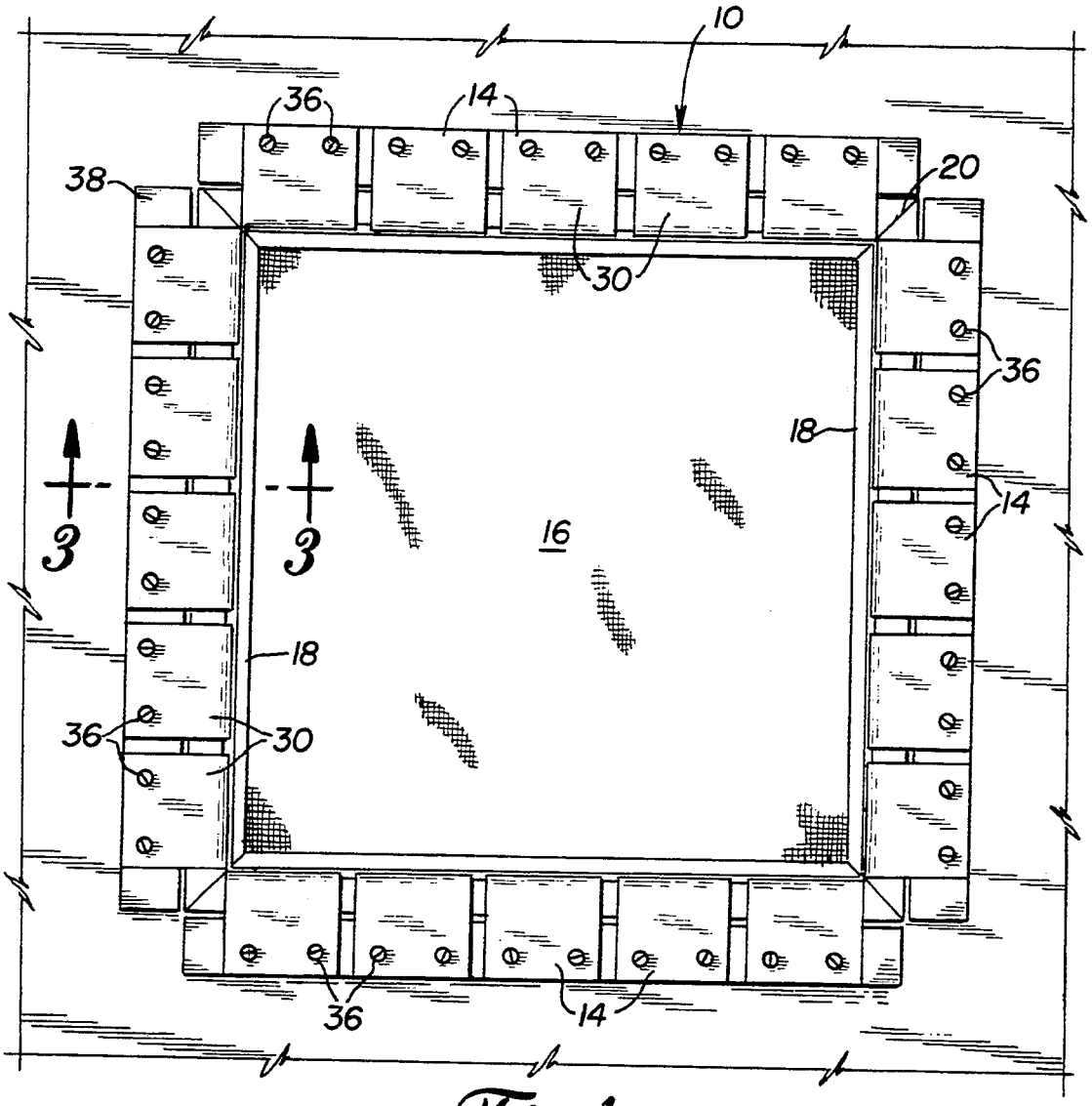
FIG. 1 is a plan view of one embodiment of the fabric panel clean change-out frame as installed on a containment showing the "clean side" thereof.

With reference to FIG. 1, one aspect of the invention is a fabric panel clean change-out frame 10 that covers and closes an opening in a base structure such as a glove box or containment 12. The exact nature of the containment 12 is not critical, other than that it should have a rigid structure to hold a panel of fabric in place in a contamination-controlling manner. However, it may be noted that glove boxes and containments are widely used in the nuclear, biological, and chemical industries, where substances whose spread would be considered undesirable must be handled.

The general construction of the fabric panel clean change-out frame 10 consists of a compressing means that is mountable on the chosen base structure in the approximate shape of the opening. For example, an arrangement of segmented retaining means, such as flat spring assemblies 14, may frame the opening of the containment which the fabric panel 16 is to cover. A further element is a closure panel of predetermined shape, generally corresponding to the shape of the opening. This panel is formed of a flexible perimeter frame having longitudinally elongated, wedge-shaped flexible frame members 18, which taper in thickness toward its outside edge. These frame members attach to the perimeter of the fabric panel 16. The springs 14 are mounted on the "clean side" or outside of the containment for ease of manipulation. The opposite side, or the "contaminated side," may be assumed to be the inside, for purposes of further description. The designation of inside or outside is merely relative and may be used for convenience of description.

In the example of FIG. 1, the fabric panel approximates a square and the flexible frame is shown to be substantially continuous over the full perimeter. At each corner of the frame, the ends are mitered to a flush contact surface 20. Although the ends are shown with a miter of forty-five degrees for purposes of such flush contact, the shape of the frame and the angle of the end miter is subject to variation. One advantage of the invention is that the fabric panel can be irregular. Thus, irregular quadrangles, triangles, and in general irregular polygons, and other shapes of choice, are accommodated. The frame members 18 can be cast, extruded, bent, machined and otherwise formed to match the required shape. Correspondingly, the abutting ends of the frame members may be configured however is required to meet with a substantially flush contact surface. Alternatively, the frame can be formed as a unitary figure, such as by molding or machining the desired shape. Still further, the abutting ends of individual frame portions can be fastened together, such as by a bonding means such as adhesive, screws or other friction fasteners.

Figure 2:
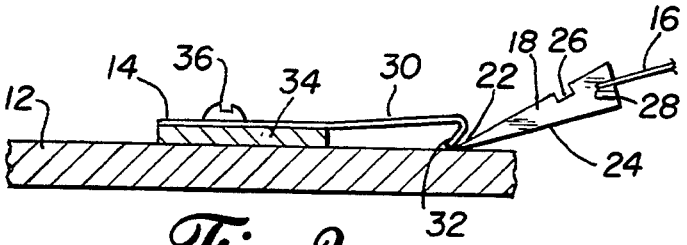
FIG. 2 is a partial cross-sectional view taken at one side of the frame, similar to the view of FIG. 3, showing an initial insertion of an original fabric panel.

With reference to FIG. 2, the elongated frame members 18 are shown to be wedge-shaped in transverse cross-section. The outer perimetric edge portion 22 of the frame may be the narrowest part of the wedge, acutely angled, for example at less than thirty degrees, terminating in the narrow edge 22 at the circumferential margin of the flexible frame's perimeter. This edge should be slim enough to permit insertion under the springs 14 for deflecting those springs, as will be subsequently described. The bottom face 24 of the frame is preferred to be flat, defining a flush contact surface that will operate as a seal means against the outside or clean side of the containment 12. The top surface of the frame includes an engaging means for positive connection and engagement with the compressing springs 14, fixing the position of the frame with respect to the springs. A groove 26, offset inwardly in from the perimeter of the flexible frame, achieves this function. Further, the frame includes a means for engaging the fabric panel. Shown is an incision or slit 28 formed on the thicker, inside face of the frame, into which the fabric is inserted and held with an adhesive. The frame and fabric may be further or alternatively joined by other Joining or bonding techniques and materials.

The combination of the fabric and the frame define a flexible closure panel that can be deformed as required for insertion under springs 14. The frame members 18 are flexible. Accordingly, they are preferred to be formed of a strong and flexible material such as low density polyethylene, tetrafluoroethylene (Teflon), or hard rubber. The fabric panel 16 must be selected according to the purpose served in any particular application. Typically, this panel will be constructed of a flexible material such as Herculite or polyethylene. In other applications, suitable examples of the material include Iridam nylon, soft rubber sheeting, Mylar, neoprene, and vinyl. Although there are many possible material choices for construction of the closure panel, the selected frame and fabric materials should be able to adhere to each other.

Each of the spring assemblies 14 is formed of a substantially flat spring body 30 having an angularly offset, hooked lip 32 depending from one end, which is the inside perimetric edge of the compression frame. A spacer 34 is located under the planar spring body, against the surface of the containment structure, so as to create a gap between the spring body and containment structure. The spring body is located on top of the spacer, with the hooked lip extending toward the containment structure and into the gap. The spring body and spacer are secured to the containment structure by a suitable fastening means, such as a pair of screws 36, passing through both. By its thickness, the spacer appropriately sets the initial spring tension. In addition, the spacer serves as a curb to stop the incoming tip 22 of the wedge-shaped flexible frame.

A plurality of the spring assemblies 14 is located in closely spaced, juxtaposed positions around the opening through the containment. Along each edge of the opening, a plurality of the springs may be carried on a single spacer bar 38, FIG. 1. In this way, the individual springs act independently while being held in a fixed position relative to the neighboring springs and the common spacer. At a corner of the shape defined by the spring assemblies, the hooked ends of the springs substantially meet, as shown in FIG. 1, so that the corner of the flexible frame is held firmly against the underlying base structure from each direction. The hooked end of each spring is set back from the edge of the opening in the containment by a small amount at least sufficient to allow the bottom face 24 of the frame member to be in substantially full contact with the outside wall of the containment structure.

Correspondingly, the groove 26 in the frame member is located to engage the hook when the frame is inserted under the spring by an appropriate distance. For example, if each spring is about 1.75 inches deep, the spacer occupies about one inch of this depth and the space between the spacer and the hooked edge occupies the balance. The wedge-shaped frame may be about one inch in depth, with the groove 26 slightly less than three-quarters inch from end 22. Thus, the wide end of the frame extends about one-quarter inch outside the hooked edge of the spring. Accordingly, the hooked edge may be set back by slightly more than one-quarter inch from the edge of the opening in order to ensure full contact between the bottom of the frame and the containment.

Figure 3:
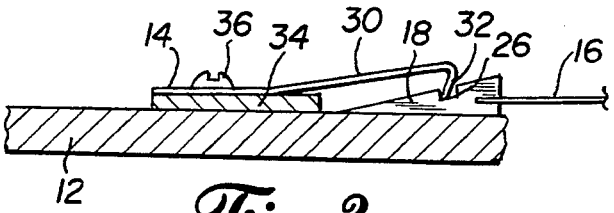
FIG. 3 is a partial cross-sectional view, taken along the plane of line 3—3 of FIG. 1, showing the original fabric panel fully inserted position.

In operation, the spring assemblies 14 are mounted as described above about the perimeter of an opening in a containment. Thereafter, the opening is sealed by the fabric closure panel and need not be opened again. The first fabric panel is installed in the new, uncontaminated containment before it is put into radiological service or other use. To do this, as shown in FIG. 2, the tip 22 of the wedge-shaped frame member 18 is inserted under the hooked end of the spring, and the wedge 18 is pushed in. When the wedge is fully inserted, the hooked edge 32 of spring 30 will lock into place in the groove 26 on the top of the wedge, as shown in FIG. 3.

Figure 6:
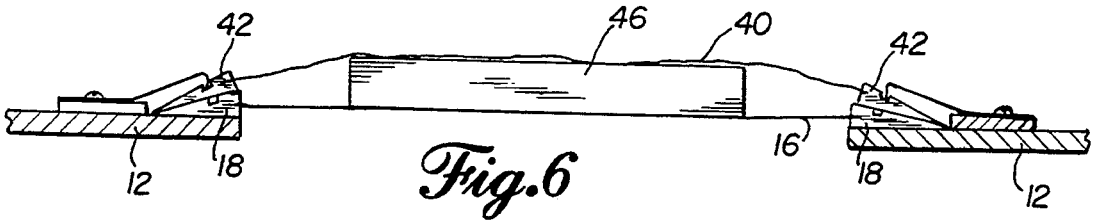
FIG. 6 is a cross-sectional view similar to FIG. 4, showing complete insertion of the replacement fabric panel, superimposed over the original panel, and containing the object for passage therebetween.

A change-out of a fabric panel 16 is performed without opening the containment. The steps are generally shown in FIGS. 5 through 8. According to FIG. 5, to install the new fabric panel 40, the wedge shaped frame 42 of the new panel is inserted under the spring 30 and on top of the old frame wedge 18. When the new wedge 42 forces the spring nook 32 out of the groove 26 on the old wedge, the old wedge no longer is locked in place. However, the frictional force of the new wedge being pushed into place and constant spring pressure on both wedges will keep the old wedge securely place. The resulting configuration of the new and old fabric panels is as shown in FIG. 6. When the new wedge 42 is fully inserted, the spring hook locks it into place by engaging groove 44. The old wedge 18 remains in place under the spring force, which has increased due to the increased spring deflection.

Figure 7:
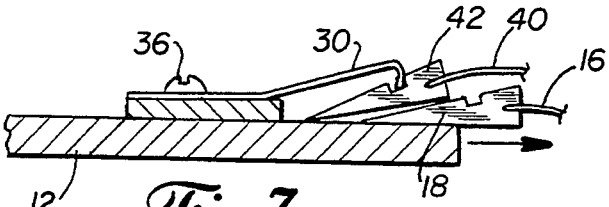
FIG. 7 is a partial cross-sectional view, similar the view of FIG. 3, showing withdrawal of the original fabric panel.
Figure 8:
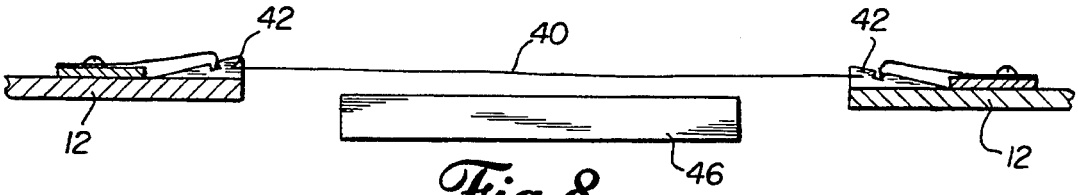
FIG. 8 is a cross-sectional view similar to FIG. 4, showing the final configuration of the frame after replacement of the original fabric panel and clean passage of the object.

Thereafter, as shown in FIG. 7, the old panel 16 is pulled out from inside the containment. If no glove port or other access is available, the fabric panel itself can have a glove built into it for the purpose of this removal, The spring hook prevents the new wedge 42 from being pulled out along with the old. The possibly contaminated surface of the containment structure 12 underneath the wedge is aided in staying uncontaminated by the fact that the wedges only wipe the surface in one direction, into the containment. The resulting configuration is as shown in FIG. 8, wherein the old panel 16 has been pulled out and into the containment for disposal. The new panel 40 has replaced the old panel.

Figure 4:
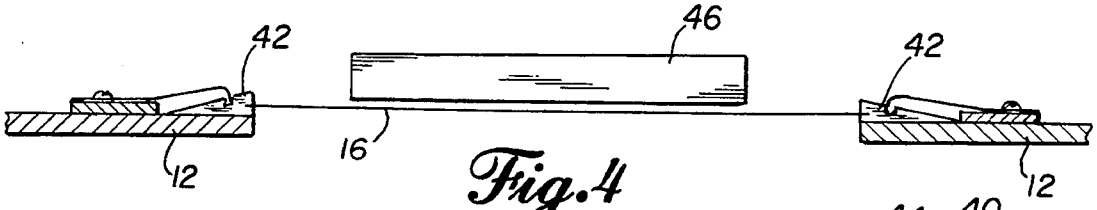
FIG. 4 is a cross-sectional view of the entire frame, showing an initial step in the clean passage of an object by placing the object adjacent to the fabric panel.
Figure 5:
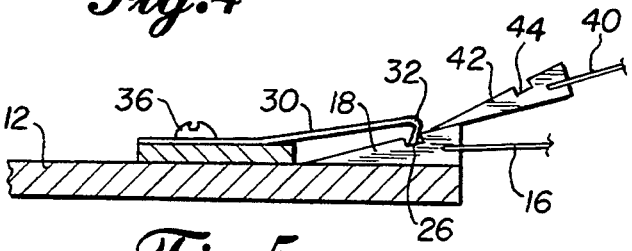
FIG. 5 is partial cross-sectional view, similar to the view of FIG. 3, showing an initial insertion of a replacement fabric panel over the original fabric panel, and the replacement panel may be understood to be over the object for passage as shown in the prior figure.

By substantially the same series of steps, a tool, replacement part or other item can be transferred into the containment, as generally shown in FIGS. 5 through 8. Initially, if an object 46 is to be transferred into the containment, this object is placed against the first or old panel 16 on the clean side of the containment, as shown in FIG. 4. Then, as previously described in connection with FIGS. 5 and 6, the new panel 40 is snapped in place over the old panel 16. The size of the item being transferred is limited by the size of the opening in the containment and by the amount of slack designed into the installed fabric panel. When the old panel 16 is pulled out, as described in connection with FIGS. 7 and 8, the object 46 is inside the containment.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. In a containment for hazardous materials, having a rigid walled base structure and an opening through a wall thereof, the improvement comprising a fabric panel clean changed-out frame having:

a closure panel of predetermined shape, including a central portion formed of flexible sheet material and a flexible perimeter frame joined to said central portion, wherein said perimeter frame tapers in thickness toward its outside edge; and a compressing means mountable, in use, on the base structure in the approximate shape of said closure panel, for retaining said perimeter frame under pressure.

2. The fabric panel clean change-out frame of claim 1, further comprising:

an engaging means for positively connecting said perimeter frame and said compressing means.

3. The fabric panel clean change-out frame of claim 2, wherein said engaging means comprises a groove formed in a face of said perimeter frame and capable of receiving therein a portion of said compressing means.

4. The fabric panel clean change-out frame of claim 3, wherein said compressing means comprises a resilient, substantially flat spring having an angularly offset lip near its inside perimetric edge, wherein a portion of said spring is received in the groove of said perimeter frame.

5. The fabric panel clean change-out frame of claim 4, wherein said portion of the spring received in said groove is a portion of said lip.

6. The fabric panel clean change-out frame of claim 5, wherein said lip is offset toward the perimeter frame and the portion of the lip received in the groove is the end edge of the lip.

7. The fabric panel clean change-out frame of claim 1, wherein said perimeter frame is wedge-shaped in transverse cross-section.

8. The fabric panel clean change-out frame of claim 4, wherein said compressing means comprises a resilient, substantially flat spring having an angularly offset lip near its inside perimetric edge, and wherein said wedge-shaped perimeter frame is at least partially receivable under said lip for deflecting the spring away from the perimeter frame.

9. The fabric panel clean change-out frame of claim 1, wherein said perimeter frame defines a slit on its inside perimetric edge; and said fabric panel is joined to the frame by receipt in said slit.

10. In a containment for hazardous materials, having a rigid walled base structure and an opening through a wall thereof, the improvement comprising a fabric panel clean change-out frame having a closure panel having approximately the same shape as said opening and overlapping the edges thereof, wherein:

a central portion of said closure panel is formed of flexible sheet material;

a longitudinally elongated flexible frame is joined to said flexible sheet material substantially at the perimeter thereof; and said frame is wedge-shaped in transverse cross-section, with the narrow portion thereof toward its outside perimetric edge; and a plurality of flat springs mounted on the base structure around the perimeter of the opening, in suitable relative positions to be capable of overlapping at least an outer portion of said frame throughout substantially its entire perimeter.

11. The fabric panel clean change-out frame of claim 10, wherein said plurality of flat springs is spaced apart around the perimeter of the opening.

12. The fabric panel clean change-out frame of claim 10, wherein one of said flat springs comprises a spring body and an angularly offset lip near its inside perimetric edge, such that said wedge-shaped perimeter frame is at least partially receivable under said lip for deflecting the spring away from the perimeter frame for enabling installation or replacement of said closure panel.

13. The fabric panel clean change-out frame of claim 12, further comprising a spacer located between said spring body and said base structure, spacing the spring body from the base structure.

14. The fabric panel clean change-out frame of claim 13, wherein said angularly offset lip is hooked toward the base structure and spacer.

15. The fabric panel clean change-out frame of claim 13, wherein a plurality of said flat springs is carried upon a single spacer.

16. In a containment for hazardous materials, having a rigid walled base structure and an opening through a wall thereof, the improvement comprising a fabric panel clean change-out frame having:

a compression frame formed of a plurality of elongated spacers, each adapted to be attached, in use, to an underlying base;

a plurality of flat springs mounted upon each of said spacers in closely spaced apart, juxtaposed positions, wherein each spring is defined by a substantially flat spring body and hooked lip extending toward the side of the spring facing the spacer;

a closure panel having a perimeter frame formed of longitudinally elongated, flexible frame members, wherein each member is wedge-shaped in transverse cross section, the narrow end of the wedge defining the perimeter of the frame and having a suitable size to be, in use, receivable under said flat springs by deflecting upwardly said hooked lips;

the flexible frame members defining on their surface facing the hooked lips a longitudinally elongated groove for engaging the lips when pushed under the flat springs and for locking the frame members in place under the springs; and a flexible fabric panel connected to the flexible frame members at the edges of the panel and closing the central portion of the closure panel.

* * * * *